US012496496B2

(12) United States Patent
Olsen, Jr.

(10) Patent No.: US 12,496,496 B2
(45) Date of Patent: Dec. 16, 2025

(54) FLUID INFLATABLE MEMBER

(71) Applicant: Sciencey Products Inc., Mount Pleasant, MI (US)

(72) Inventor: Charles William Olsen, Jr., Mount Pleasant, MI (US)

(73) Assignee: Sciency Products Inc., Frankfort, MI (US)

( * ) Notice: Subject to any disclaimer, the term of this patent is extended or adjusted under 35 U.S.C. 154(b) by 634 days.

(21) Appl. No.: 17/873,417

(22) Filed: Jul. 26, 2022

(65) Prior Publication Data

US 2024/0033581 A1 Feb. 1, 2024

(51) Int. Cl.
*A63B 31/10* (2006.01)

(52) U.S. Cl.
CPC ..... *A63B 31/10* (2013.01); *A63B 2225/605* (2013.01); *A63B 2225/62* (2013.01)

(58) Field of Classification Search
CPC ..... A63B 31/10; A63B 31/11; A63B 2225/60; A63B 2225/62; A63B 2210/50; B63B 7/08
USPC ..... 441/40, 61, 64
See application file for complete search history.

(56) References Cited

U.S. PATENT DOCUMENTS 2,850,252 A * 9/1958 Ford ..... B64F 1/36 244/114 R
2,997,100 A * 8/1961 Morris ..... A47C 27/18 5/709
3,872,525 A * 3/1975 Lea ..... A47C 27/088 5/709
4,025,974 A 5/1977 Lea et al.
6,082,667 A 7/2000 Haggard
6,793,549 B1 9/2004 Chiang
7,056,179 B2 6/2006 Courtney
9,211,441 B1 12/2015 Lawrence
10,045,647 B2 * 8/2018 Publicover ..... A63B 21/023
2012/0196079 A1 8/2012 Brauers et al.
2013/0000047 A1 1/2013 McCann et al.
2017/0007933 A1 1/2017 Newton
2018/0312232 A1 11/2018 de Grasse

FOREIGN PATENT DOCUMENTS

CN 110833681 A * 2/2020 ..... A63B 31/11

OTHER PUBLICATIONS

Structural behaviour of inflatable PVC fabric cylindrical tubes, Sherif Okda et al 2019, accessed Jul. 2022, 10 pages.

(Continued)

*Primary Examiner* — Daniel V Venne
(74) *Attorney, Agent, or Firm* — Young Basile Hanlon & MacFarlane, P.C.

(57) ABSTRACT

A fluid inflatable member includes a pliable body having a membrane defining an expandable interior space and including an edge defining an opening through the pliable body and an expandable and compressible porous material enclosed within the expandable interior space of the pliable body. The porous material is configured to receive an amount of fluid and distribute the fluid throughout the interior space to increase a rigidity of the pliable body.

19 Claims, 7 Drawing Sheets

(56) References Cited

OTHER PUBLICATIONS

Membranes structures formed by low pressure inflatable tubes. New analysis methods and recent constructions, Eugenio Oñate, Fernando Flores, Javier Marcipar (2007), accessed Jul. 2022, 27 pages.
Structural Behavior of Inflatable, Reinforced, Braided, Tubular Members, Joshua Clapp (Aug. 17, 2017), Accessed Jul. 2022, 144 pages.

* cited by examiner

FLUID INFLATABLE MEMBER

TECHNICAL FIELD

This disclosure relates to a fluid inflatable member.

BACKGROUND

Air-inflated members such as rafts, floatation vests, water toys, or air-filled tubes lack sufficient rigidity to function as support members for various projects, such as construction or for use as a swimming aid, such as a swim fin.

Furthermore, air-filled swimming aid devices can be easily kinked or bent.

SUMMARY

Disclosed herein are implementations of a fluid inflatable member that includes a semi-permeable or impermeable membrane enclosing a compressible foam material. The foam material has a porosity configured to permit an influx of an incompressible fluid such that the fluid inflatable member retains rigidity when exposed to a bending moment or torsional load.

In one implementation of the disclosure, a fluid inflatable member includes a pliable body having a membrane defining an expandable interior space and including an edge defining an opening through the pliable body and an expandable and compressible porous material enclosed within the expandable interior space of the pliable body. The porous material is configured to receive an amount of fluid and distribute the fluid throughout the interior space to increase a rigidity of the pliable body.

In some aspects, the fluid inflatable member further includes a valve coupled to the pliable body and communicating with the porous material to allow ingress and egress of the fluid to the pliable body to selectively expand and contract the pliable body.

In some aspects, the fluid inflatable member further includes a bladder formed in a fin body and a blade portion coupled the fin body and extending forward from the fin body. The pliable body includes a first pliable body coupled to a first side of the fin body and enclosing the porous material and a second pliable body coupled to a second side of the fin body opposite the first side and enclosing the porous material. The first and second pliable bodies are arranged such that the first and second pliable bodies are on either side of the bladder and each of the first and second pliable bodies are in fluid communication with the bladder such that a flow of liquid from the bladder expands the first and second pliable bodies and a flow of fluid to the bladder allows compression of the first and second pliable bodies.

In some aspects, the fin body defines an opening positioned underneath the bladder and between the first and second pliable bodies such that the opening is configured to receive a foot.

In some aspects, the membrane is impermeable. In some aspects, the membrane is semi-permeable.

In some aspects, the porous material of the pliable body is expandable to a cylindrical support structure upon a flow of liquid to the pliable body.

In some aspects, the porous material of the pliable body is an open-cell foam having a pore size between approximately 0.1 mm and approximately 4 mm.

In some aspects, the porous material of the pliable body is an open-cell foam having a minimum pore size of approximately 1 mm.

In some aspects, the fluid inflatable member is expandable between a first configuration in which the fluid inflatable member is in a compressed configuration and a second configuration in which the fluid inflatable member is in an expanded configuration.

In some aspects, the compressed configuration is a rolled configuration, and the expanded configuration forms a semi-rigid structural member.

In some aspects, a rigidity of the semi-rigid structural member depends on a cellular structure of the porous material and an amount of liquid enclosed within the porous material.

In some aspects, the fluid inflatable member further includes a compressible member coupled with the membrane such that, as the membrane is filled with fluid, the compressible member expands to assume a predefined shape and, when fluid is no longer directed into the membrane, the compressible member retracts to contract the fluid inflatable member to an uninflated configuration.

In some aspects, the predefined shape is a cylinder.

In another implementation of the disclosure, a method for manufacturing a fluid inflatable member includes providing a pliable body having a membrane defining an expandable interior space and an opening in the membrane and inserting a porous material into the interior space of the pliable body. The pliable body expands and contracts between a first configuration and a second configuration.

In some aspects, the method further includes coupling a valve to the opening in the membrane.

In another implementation of the disclosure, a method for manufacturing a fluid inflatable member includes forming a membrane around a porous material such that the porous material is enclosed within the membrane, forming an opening in the membrane, and coupling a valve to the membrane, the valve configured to enable an expansion of the fluid inflatable member through an influx of liquid to the porous material.

In some aspects, the porous material comprises an open-cell foam.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

The present disclosure provides a fluid inflatable member, such as an inflatable swim fin or an inflatable structural support member, which includes at least one chamber that can be filled with an incompressible fluid to retain shape and rigidity during use. In some embodiments, the fluid inflatable member includes a chamber filled with a porous material such as a bonded or unbonded open-celled foam that, when filled with an incompressible fluid such as water, expands from a storage position (such as a rolled position) to a use position. The porous material provides a self-inflating capability due to the expansion of the elastomeric foam and limits the flow of fluid from point-to-point within the chamber to reduce kinking or undesired bending of the fluid inflatable member. The level of rigidity of the fluid inflatable member is provided by the fluid-filled chamber or chambers.

A collapsible fluid-filled support member as described herein may also be used in construction, such as to provide anchoring against wind loads for temporary structures. In some implementations, a collapsible fluid-filled support member acts as ballast and/or a keel for an inflatable watercraft or boat and can provide rigidity for underwater structures when neutral buoyancy is desired.

Figure 1:
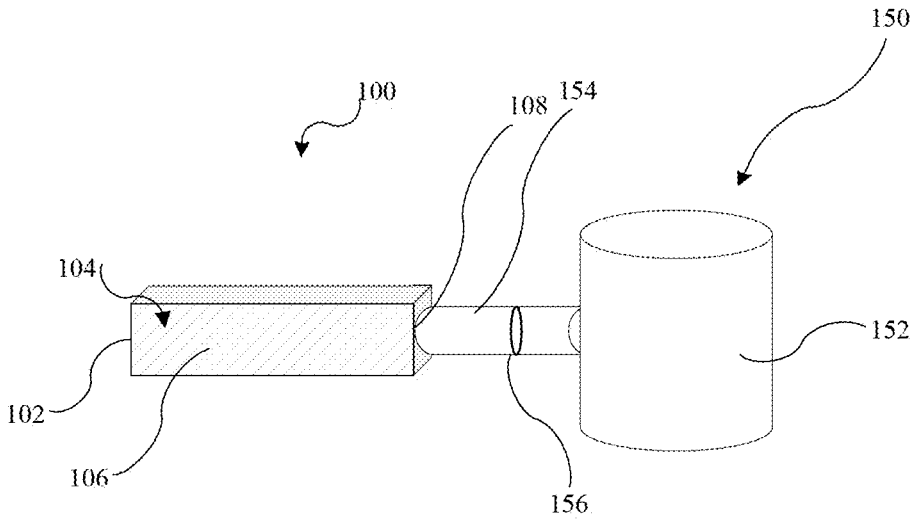
FIG. 1 is a schematic diagram of a fluid inflatable member connected with a valve to a fluid source in an uninflated configuration, according to a first implementation.

FIG. 1 is a schematic diagram of a first implementation of a fluid inflatable member 100, shown in a first configuration, which is an uninflated or unexpanded configuration prior to inflation. The fluid inflatable member 100 is a pliable body defined by an impermeable or semi-permeable membrane 102 that defines a chamber 104. The chamber 104 may also be referred to as an expandable interior space. The chamber 104 is filled with a porous material 106, such as an open-cell foam material. In various implementations, the porous material 106 is an elastic, expandable and compressible, open-cell foam that, in an unrestrained state, maintains a predefined shape in air or water. The predefined shape is determined by the membrane 102. In various implementations, the membrane 102 is a fabric membrane, flexible fabric membrane, or another flexible, impermeable or semi-impermeable material.

The fluid inflatable member 100 includes an edge 108 defining an opening into the chamber 104. The fluid inflatable member 100 is coupled to a fluid source 150 via the opening in the chamber 104 defined by the edge 108. In some implementations, the fluid source 150 includes a bladder 152 and a connecting member 154. In various implementations, the bladder 152 may be a tank or other repository of an incompressible fluid. The connecting member 154 may be a tube, hose, or other conduit configured to transmit the incompressible fluid, such as water, between the bladder 152 and the chamber 104 of the fluid inflatable member 100. In various implementations, a valve 156 is positioned between the fluid inflatable member 100 and the bladder 152 to regulate a flow of fluid between the fluid inflatable member 100 and the bladder 152. In various embodiments, the valve 156 is a one-way or two-way valve. It is understood that any type of fluid regulating valve or device may be used as the valve 156. In various implementations, the valve 156 is an eversion valve that allows fluid ingress to the chamber 104 under suction, prevents fluid loss at moderate differential pressure, and everts to allow high flow rates of fluid egress from the chamber 104 under high pressure. Upon removal of the high pressure, the valve 156 reverts to its original configuration. Details such as rates of fluid ingress and egress are controlled by the design of the valve 156, the selection of materials for the porous material 106 and the membrane 102, as well as the physical configuration of the fluid inflatable member 100.

Figure 2:
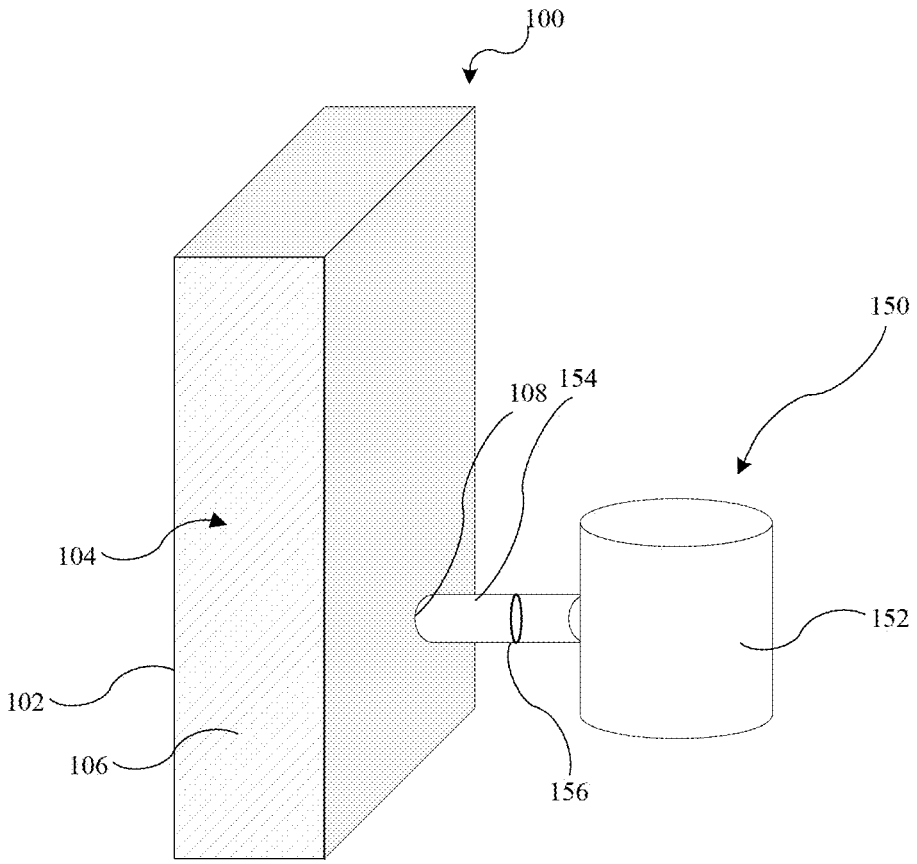
FIG. 2 is a schematic diagram of the fluid inflatable member of FIG. 1 in an inflated configuration.

The fluid inflatable member 100 has a first configuration defined as an uninflated or compressed configuration and a second configuration defined as an inflated or expanded configuration. In various implementations, in the uninflated configuration, as shown in FIG. 1, the fluid inflatable member 100 has a rigidity or stiffness that is less than when the fluid inflatable member 100 is in the second or inflated configuration. In the first configuration, the pores (e.g., holes or openings) throughout the porous material 106 are filled with gas, such as air. As the fluid inflatable member 100 receives fluid from the fluid source 150, the air contained within the porous material 106 is displaced by the fluid, such as water. In various implementations, the air is forced across the membrane 102 into the surrounding environment by the incursion of the incompressible fluid into the pores dispersed throughout the porous material 106. The incursion of the incompressible fluid into the pores of the porous material expands the fluid inflatable member 100 from the first configuration, shown in FIG. 1, to the second configuration, shown in FIG. 2. The increased rigidity or stiffness provided by the fluid contained within the porous material 106 enables the fluid inflatable member 100 to be used wherever a rigid member is desired, such as a support member for construction, as a medium for outdoor advertising, etc., for example and without limitation. In the second configuration, as shown in FIG. 2, the fluid inflatable member 100 is a support member that resists bending forces due to wind, for example, or water current, if used as a semi-rigid structural member or support structure.

Figure 3:
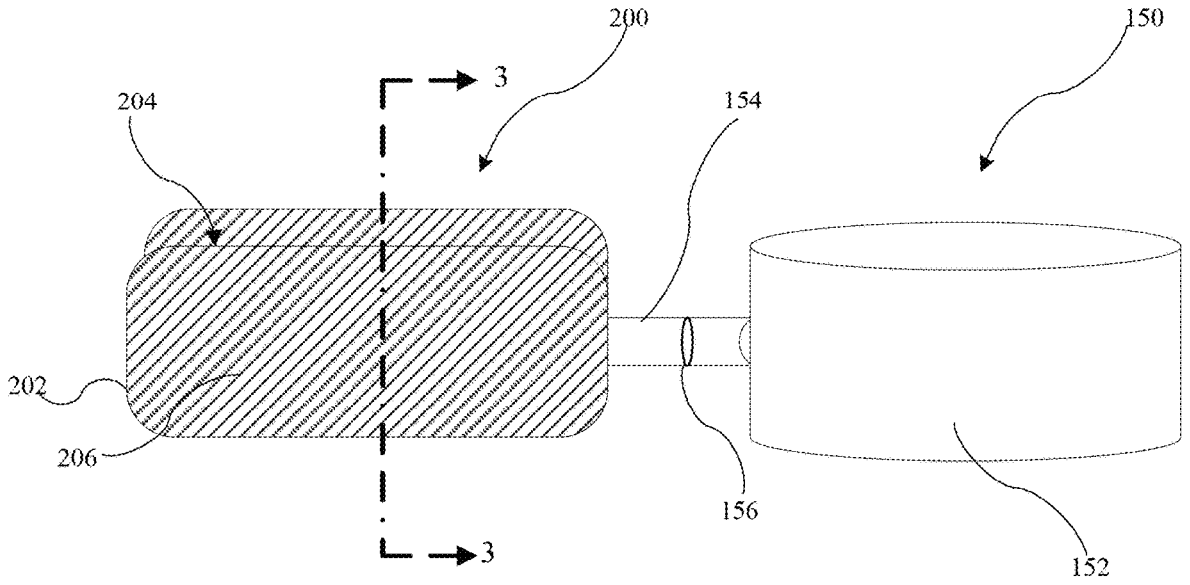
FIG. 3 is a schematic diagram of a fluid inflatable member connected with a valve to a fluid source, according to a second implementation.
Figure 4:
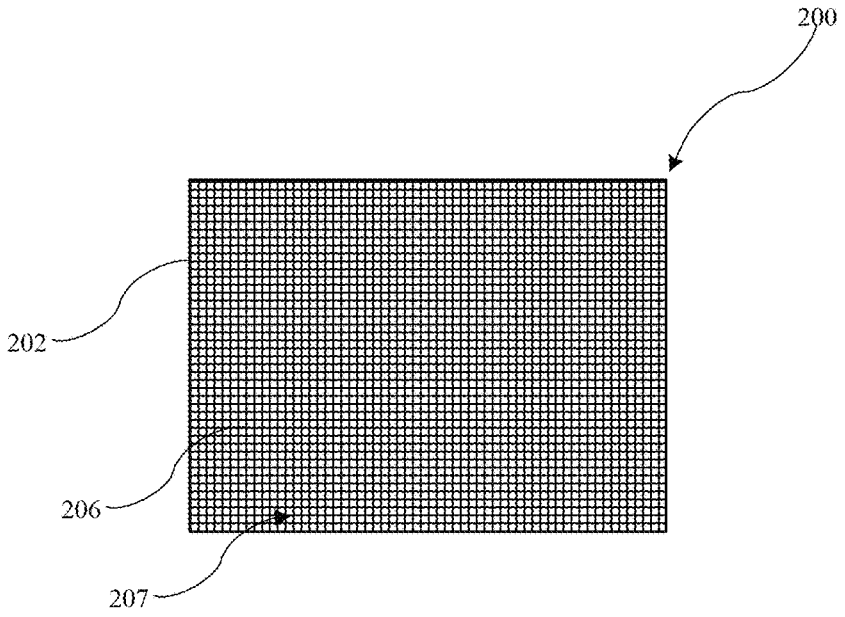
FIG. 4 is a cross-sectional diagram of the fluid inflatable member of FIG. 2.

With reference now to FIGS. 3 and 4, a second implementation of a fluid inflatable member 200 is shown. Like the fluid inflatable member 100 shown in FIG. 1, the fluid inflatable member 200 is a pliable body defined by an impermeable or semi-permeable membrane 202 that defines a chamber 204. The chamber 204 is filled with a porous material 206, such as an open-cell foam. In various implementations, the porous material 206 is an elastic, open-cell foam that, in an unrestrained state, maintains a predefined shape in air. The predefined shape is determined by the membrane 202. In various implementations, the membrane 202 is a fabric membrane.

The fluid inflatable member 100 is coupled to a fluid source 150 such as the fluid source 150 described with reference to FIG. 1. In various implementations, a valve 156 is positioned between the fluid inflatable member 100 and the bladder 152 to regulate a flow of fluid between the fluid inflatable member 100 and the bladder 152. In various embodiments, the valve 156 is a one-way or two-way valve. It is understood that any type of fluid regulating valve or device may be used as the valve 156.

FIG. 4 illustrates a cross-section of the fluid inflatable member 200. The cross-section schematically illustrates a cellular structure of the fluid inflatable member 200 including a plurality of pores (e.g., holes, cells, or openings) 207 in the porous material 206. In the illustrated implementation, the pores 207 are regularly spaced. However, in other implementations, the pores 207 may be irregularly spaced throughout the porous material 206. Furthermore, the density and size of the pores 207 may be continuous throughout the porous material 206 or may vary (i.e., more or fewer pores 207 near the edges of the porous material 206 adjacent to the membrane 202). The size and distribution of the pores 207 within the porous material 206 depends on the desired rigidity of the fluid inflatable member 200 when in the second configuration (i.e., when the fluid inflatable member 200 is filled with an incompressible fluid). In various implementations, the pore size of the pores 207 is between approximately 0.1 mm and approximately 4 mm. In various implementations, a minimum pore size of the pores 207 is approximately 1 mm.

Figure 5:
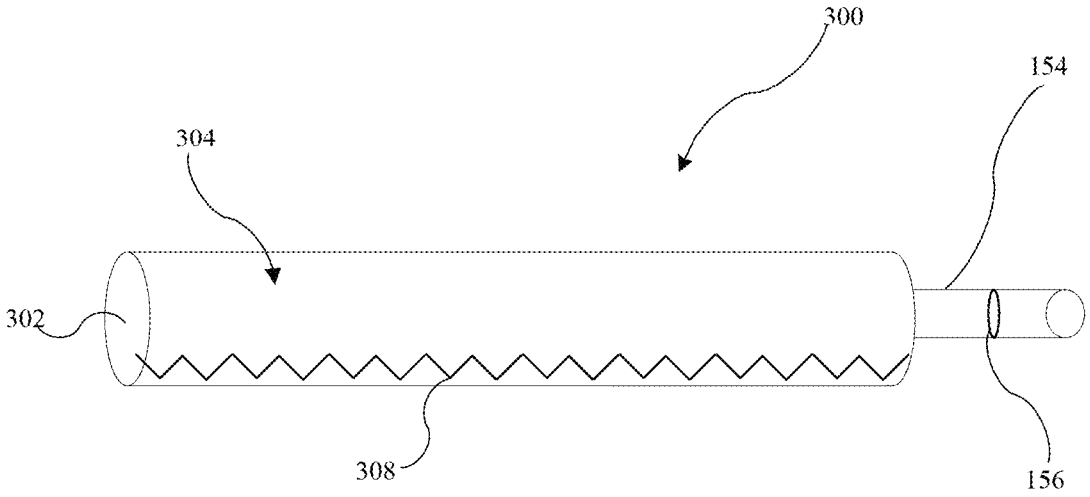
FIG. 5 is a schematic diagram of a fluid inflatable member according to a third implementation, shown in a first configuration.

FIG. 5 is a schematic illustration of another implementation of a fluid inflatable member 300. In this implementation, the fluid inflatable member 300 is formed as an extended cylinder. Like the fluid inflatable members 100, 200, the fluid inflatable member 300 is a pliable body defined by an impermeable or semi-permeable membrane 302 that defines a chamber 304. The predefined shape is determined by the membrane 302. In various implementations, the membrane 302 is a fabric membrane. In this implementation, in addition to a porous foam, the chamber 304 includes a compressible member 308, such as a coiled spring 308. The compressible member 308 (e.g., coiled spring) is coupled with the membrane 302 (e.g., extending a longitudinal length of the pliable body) such that, as the membrane 302 is filled with fluid, the compressible member 308 expands such that the fluid inflatable member 300 assumes the predefined shape (that is, a cylinder, or cylindrical support structure, as shown in FIG. 5). The compressible member 308 exerts a force that acts to return the fluid inflatable member 300 to an uninflated configuration by pushing the fluid out of the of the fluid inflatable member 300. That is, the compressible member 308 retracts when fluid is no longer directed into the fluid inflatable member 300 by a fluid source. As the compressible member 308 retracts, the fluid inflatable member 300 contracts to an uninflated configuration, such as the rolled configuration shown in FIG. 6.

The fluid inflatable member 300 includes a connecting member 154 and a valve 156. The connecting member 154 us used to transfer fluid between a bladder, such as the bladder 150, or another source of incompressible fluid, and the chamber 304 of the fluid inflatable member 300. While the fluid inflatable member 300 is shown having a valve 156 positioned (e.g., disposed) within the connecting member 154, it is understood that the fluid inflatable member 300 is valveless in other implementations. Additionally, the valve 156 may be positioned at any point between the source of incompressible fluid and the fluid inflatable member 300, such as at the surface of the membrane 302.

Figure 6:
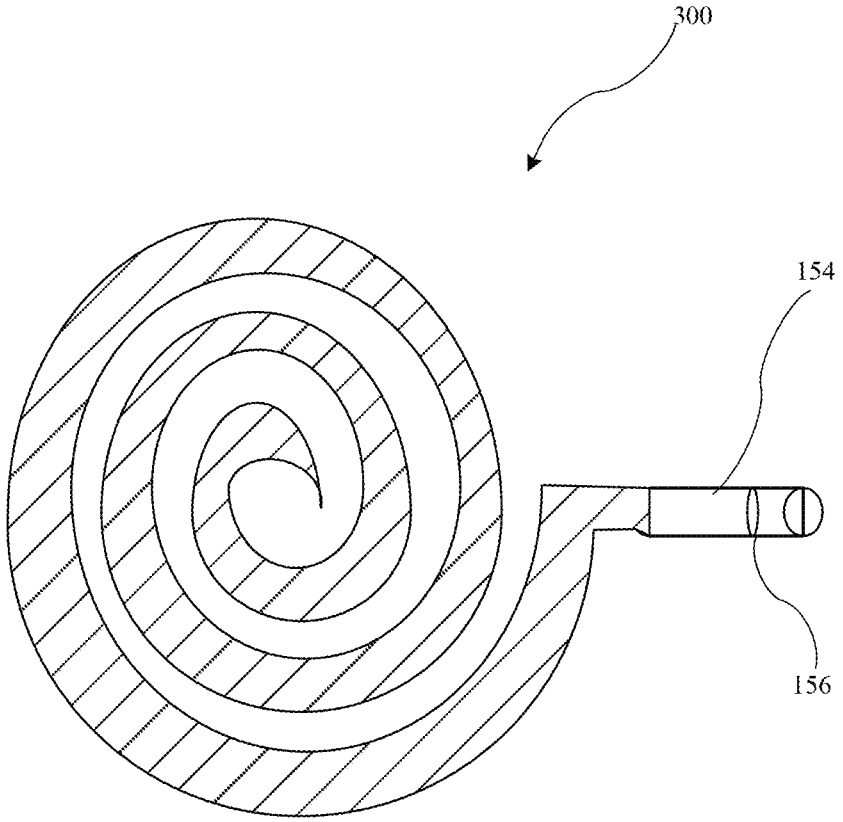
FIG. 6 is a schematic diagram of the fluid inflatable member of FIG. 4 shown in a second configuration.

FIG. 6 illustrates the fluid inflatable member 300 in a third configuration. In various implementations, the third configuration is the uninflated configuration (i.e., the fluid inflatable member 300 is rolled, compressed, folded, or otherwise manipulated into a smaller form factor). In the uninflated configuration, the fluid inflatable member 300 can be more easily stored or transported, due to the smaller form factor. In the illustrated implementation, the fluid inflatable member 300 has been rolled into a spiral shape for easier transport and/or storage. In some configurations, as shown in FIG. 5, the fluid inflatable member 300 includes the compressible member 308 that retracts to force the fluid from the chamber 304 and roll the fluid inflatable member 300 into a spiral-rolled configuration as shown. In some implementations, the incompressible fluid is removed from the fluid inflatable member 300 such as by squeezing the fluid inflatable member 300, pumping, compression due to retraction of a coiled spring coupled to the membrane 302, or other fluid removal means.

Figure 7:
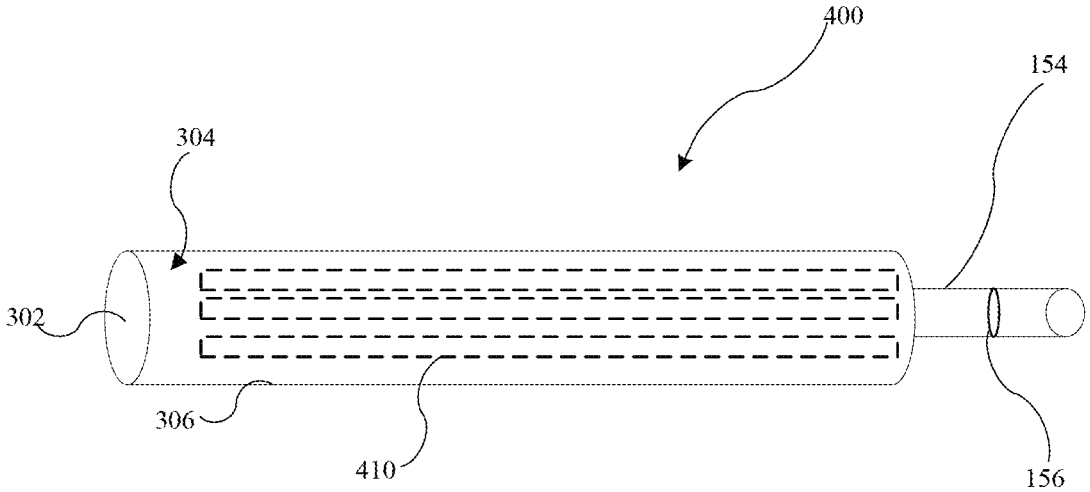
FIG. 7 is a schematic diagram of a fluid inflatable member, according to a fourth implementation.

Another implementation of a fluid inflatable member 400 is shown in FIG. 7. The fluid inflatable member 400 differs from the fluid inflatable member 300 in that the fluid inflatable member 400 includes at least one pre-formed channel 410 that extends through the length of the fluid inflatable member 400 and does not include a compressible member or coiled spring coupled to the membrane 302. Fluid pumped or directed into the fluid inflatable member 400 from a fluid source via the connecting member 154 is directed to the pre-formed channel 410 to more easily and directly inflate the membrane 302. The other details of the fluid inflatable member 400 are similar to those discussed with respect to the fluid inflatable members 100, 200, and 300.

Figure 8:
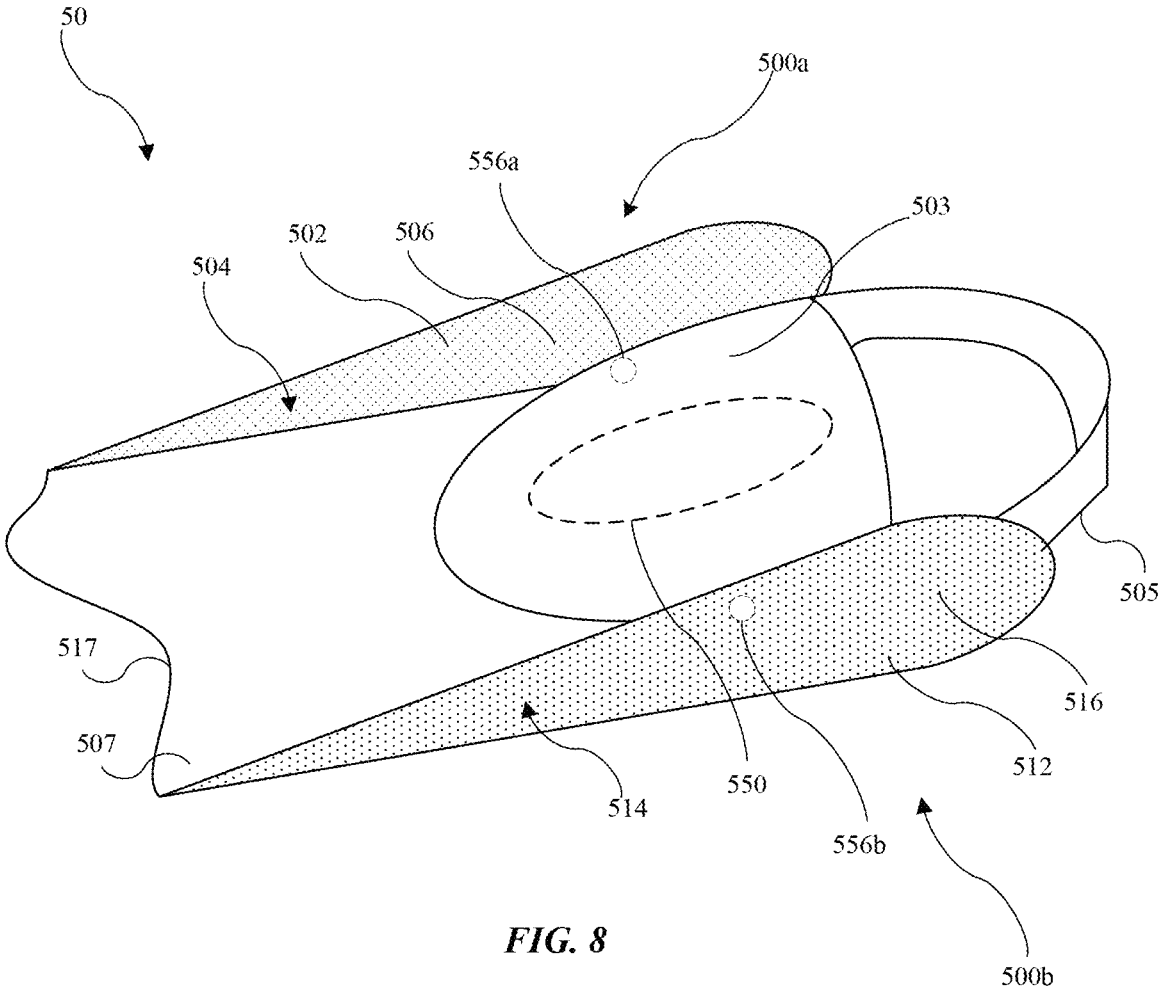
FIG. 8 is a schematic diagram of a swimming fin including two fluid inflatable members.

An embodiment of an inflatable swim fin 50 incorporating at least one fluid inflatable member 400 is shown schematically in FIG. 8. The inflatable swim fin 50 includes a first fluid inflatable member **500*a* (i.e., a first pliable body) and a second fluid inflatable member 500*b* (i.e., a second pliable body) positioned on either side of a fin body 503. The fin body 503 includes a hollowed-out portion or opening configured to receive a user's foot. The fin body 503 also includes a bladder 550. The bladder 550, like the bladder 150, contains an amount of fluid used to inflate the first fluid inflatable member 500*a* and the second fluid inflatable member 500*b*. The first fluid inflatable member 500*a* and the second fluid inflatable member 500*b* are both in fluid communication with the bladder 550. The hollowed-out portion or opening in the fin body 503 is positioned underneath the bladder 550**.

The first fluid inflatable member **500*a* is a pliable body defined by an impermeable or semi-permeable membrane 502 that defines a chamber 504. The chamber 504 is filled with a porous material 506, such as an open-cell foam. In various implementations, the porous material 506 is an elastic, open-cell foam that, in an unrestrained state, maintains a predefined shape in air. The predefined shape is determined by the membrane 502. In various implementations, the membrane 502** is a fabric membrane.

Similarly, the second fluid inflatable member **500*b* is a pliable body defined by an impermeable or semi-permeable membrane 512 that defines a chamber 514. The chamber 514 is filled with a porous material 516, such as an open-cell foam. In various implementations, the porous material 516 is an elastic, open-cell foam that, in an unrestrained state, maintains a predefined shape in air. The predefined shape is determined by the membrane 512. In various implementations, the membrane 512** is a fabric membrane.

The inflatable swim fin 50 also includes a strap 505. The strap 505 extends from the fin body 503 and is configured to hold the inflatable swim fin 50 on the user's foot. A rigid blade portion 507 extends forward from the fin body 503 and is positioned between the first fluid inflatable member **500*a* and the second fluid inflatable member 500*b*. The rigid blade portion 507 enables the user to displace water during a foot stroke using the inflatable swim fin 50. In various implementations, the rigid blade portion 507 is a semi-rigid plastic that can be folded or rolled for storage or transport of the inflatable swim fin 50**.

Each of the first fluid inflatable member 500*a* and the second fluid inflatable member 500*b* has an elongated tear drop shape such that a wider portion of each of the first fluid inflatable member 500*a* and the second fluid inflatable member 500*b* is positioned near the fin body 503 and adjacent to the strap 505. The opposite ends of each of the first fluid inflatable member 500*a* and the second fluid inflatable member 500*b* are near the edge 517 of the rigid blade portion 507 such that each of the first fluid inflatable member 500*a* and the second fluid inflatable member 500*b* narrows to a point.

The first fluid inflatable member 500*a* includes a first valve 556*a* and the second fluid inflatable member 500*b* includes a second valve 556*b*. The first valve 556*a* is positioned on a first side of the bladder 550 and allows a flow of fluid between the bladder 550 and the first fluid inflatable member 500*a*. Similarly, the second valve 556*b* is positioned on a second side of the bladder 550 opposite the first side and allows a flow of fluid between the bladder 550 and the second fluid inflatable member 500*b*.

The inflatable swim fin 50 can be rolled, folded, or otherwise manipulated to a smaller shape for transport and storage, as discussed above with respect to the fluid inflatable members 100, 200, 300, and 400. While the first inflatable member 500*a* and the second inflatable member 500*b* of the inflatable swim fin 50 are shown as filled with the porous material 506 it is understood that the first fluid inflatable member 500*a* and the second fluid inflatable member 500*b* can include features of the fluid inflatable members 300 and 400 discussed above, such as the coiled spring of the fluid inflatable member 300 and the pre-formed channels of the fluid inflatable member 400.

Figure 9:
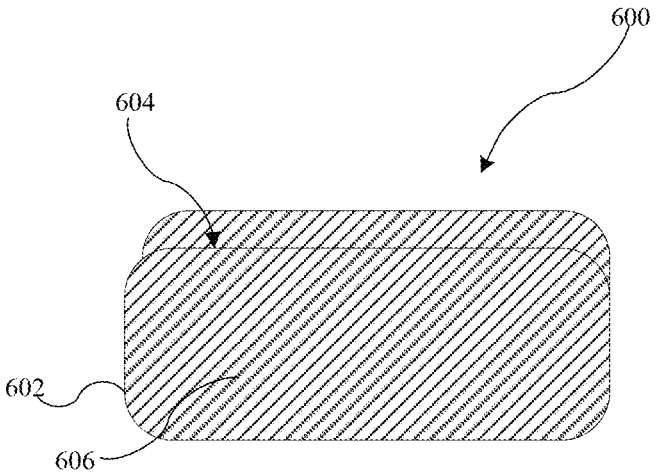
FIG. 9 is a schematic diagram of a fluid inflatable member having a valveless construction.

A valveless implementation of a fluid inflatable member 600 is shown in FIG. 9. In this implementation, the fluid inflatable member 600 is similar to the fluid inflatable members 100, 200, 300, and 400 discussed herein. In the illustrated implementation, the fluid inflatable member 600 includes an impermeable or semi-permeable membrane 602 that defines a chamber 604. The chamber 604 is filled with a porous material 606, such as an open-cell foam. In various implementations, the porous material 606 is an elastic, open-cell foam that, in an unrestrained state, maintains a predefined shape in air. In other implementations, the fluid inflatable member 600 includes a compressible member as discussed with respect to the fluid inflatable member 300 or one or more pre-formed channels as discussed with respect to the fluid inflatable member 400. The predefined shape is determined by the membrane 602. In various implementations, the membrane 602 is a fabric membrane.

In response to the fluid inflatable member 600 being compressed, air is expelled through the membrane 602. The membrane 602 is then allowed to re-expand as a fluid fills the pores of the porous material 606. Once the fluid inflatable member 600 has achieved its full volume of liquid through the membrane 602, the flow of liquid out of the fluid inflatable member 600 is so low that the incompressible nature of the ingested liquid makes the fluid inflatable member 600 orders of magnitude more rigid than an air-filled fluid inflatable member 600.

With rapid application of load the fluid inflatable member 600 acts as if the membrane 602 is impermeable. However, under a lower rate of loading the ingested liquid passes through the membrane 602 and the fluid inflatable member 600 would collapse.

For each of the fluid inflatable members 100, 200, 400, 500, 600, parameters such as the open-cell foam elasticity, porosity, and membrane permeability to liquid and gas are determined based on the desired rigidity of the inflated fluid inflatable member.

Figure 10:
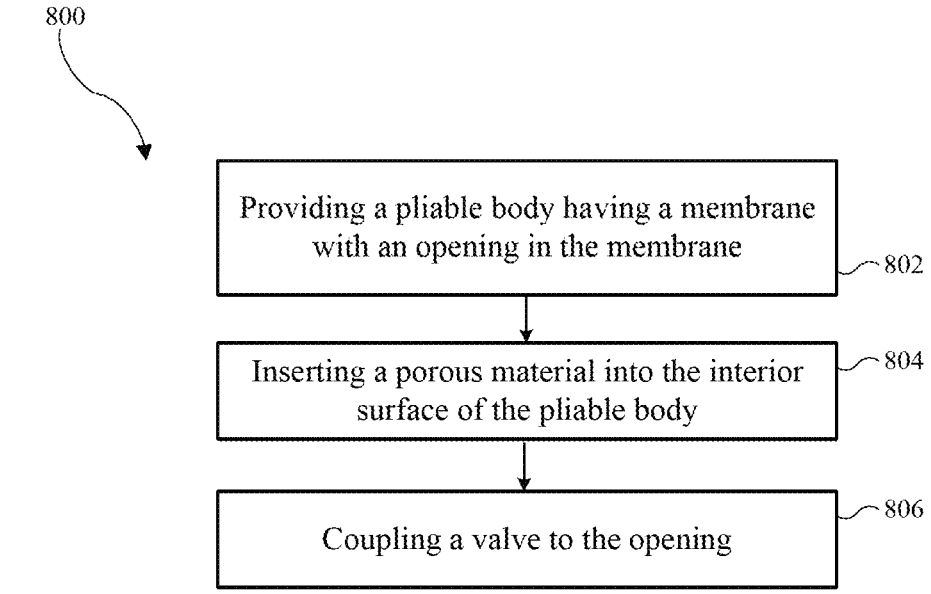
FIG. 10 is a flow diagram of a method for manufacturing a fluid inflatable member, according to a first implementation.

FIG. 10 is a flow diagram of a method 800 for manufacturing a fluid inflatable member, such as the fluid inflatable members 100, 200, 300, 400, 500. The steps illustrated may be performed in another order than that listed.

First, at step 802, a pliable body having a membrane defining an expandable interior space is provided. The pliable body includes an opening in the membrane. Next, at 804, a porous material is inserted into the interior space of the pliable body. At 806, a valve is coupled to the opening in the membrane.

Figure 11:
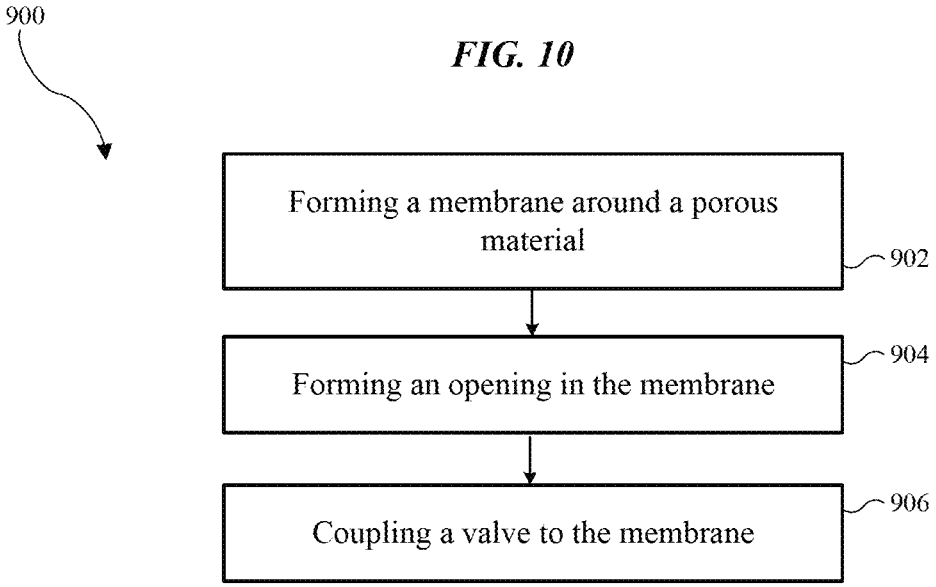
FIG. 11 is a flow diagram of a method for manufacturing a fluid inflatable member, according to a second implementation.

FIG. 11 is a flow diagram of a method 900 for manufacturing a fluid inflatable member, such as the fluid inflatable members 100, 200, 300, 400, 500. The steps illustrated may be performed in another order than that listed.

First, at step 902, a membrane is formed around a porous material such that the porous material is enclosed within the membrane. Next, at 904, an opening is formed in the membrane. At 906, a valve is coupled to the membrane. The valve is configured to enable an expansion of the fluid inflatable member through an influx of liquid to the porous material.

Figure 12:
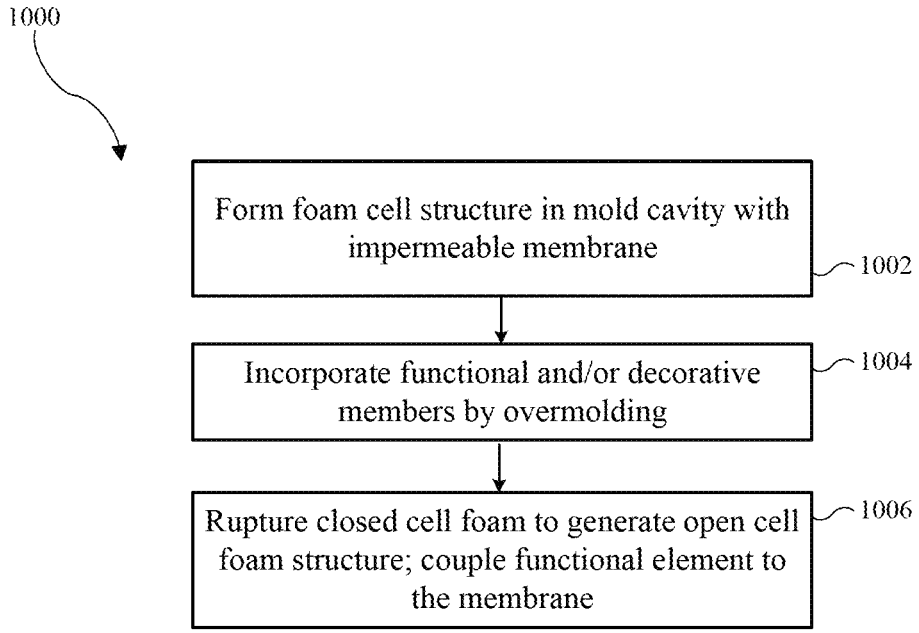
FIG. 12 is a flow diagram of a method for manufacturing a fluid inflatable member, according to a third implementation.

FIG. 12 is a flow diagram of a method 1000 for manufacturing a fluid inflatable member, such as the fluid inflatable members 100, 200, 300, 400, 500. The steps illustrated may be performed in another order than that listed.

First, at step 1002, the cell structure of the foam is generated inside a mold cavity while simultaneously forming an impermeable membrane against the walls of the cavity, as part of a reaction injection molding process. Next, at 1004, other elements such as a rigid valve or other plastic or metal decorative or functional members can be incorporated into the cell structure by overmolding. At 1006, after molding is complete, secondary operations may be performed, such as rupturing the closed cell foam to generate an open cell structure internal to the molded object. In this step, other decorative or functional elements may also be added to the fluid inflatable member, such as coupling a valve, etc.

As used in the claims, phrases in the form of "at least one of A, B, or C" should be interpreted to encompass only A, or only B, or only C, or any combination of A, B and C.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A fluid inflatable member, comprising:

a pliable body having a membrane defining an interior space; and a porous material enclosed within the interior space of the pliable body, wherein in response to the porous material being compressed, air within the porous material is expelled through the membrane as the porous material receives incompressible fluid from a fluid source and distributes the incompressible fluid throughout the interior space to increase a rigidity of the pliable body.

2. The fluid inflatable member of claim 1, further comprising a valve coupled to the pliable body and communicating with the porous material to allow ingress and egress of the incompressible fluid to the pliable body to selectively expand and contract the pliable body.

3. The fluid inflatable member of claim 1, wherein a blade portion is coupled with a fin body and extends forward from the fin body, wherein the pliable body comprises a first pliable body coupled to a first side of the fin body and enclosing a first portion of the porous material and a second pliable body coupled to a second side of the fin body opposite the first side and enclosing a second portion of the porous material, wherein the fluid source is a bladder formed in the fin body, and wherein the first and second pliable bodies are in fluid communication with the bladder such that a flow of incompressible fluid from the bladder expands the first and second pliable bodies and a flow of incompressible fluid to the bladder allows compression of the first and second pliable bodies.

4. The fluid inflatable member of claim 3, wherein the first and second pliable bodies are arranged are on opposite sides of the bladder, and wherein the fin body defines an opening positioned underneath the bladder and between the first and second pliable bodies such that the opening is configured to receive a foot.

5. The fluid inflatable member of claim 1, wherein at least a portion of the membrane is impermeable.

6. The fluid inflatable member of claim 1, wherein at least a portion of the membrane is semi-permeable.

7. The fluid inflatable member of claim 1, wherein the porous material of the pliable body is expandable into a cylindrical support structure upon a flow of liquid incompressible fluid to the pliable body.

8. The fluid inflatable member of claim 1, wherein the porous material of the pliable body is an open-cell foam having a pore size between approximately 0.1 mm and approximately 4 mm.

9. The fluid inflatable member of claim 1, wherein the porous material of the pliable body is an open-cell foam having a minimum pore size of approximately 1 mm.

10. The fluid inflatable member of claim 1, wherein the inflatable member is expandable between a first configuration in which the inflatable member is in a compressed configuration and a second configuration in which the inflatable member is in an expanded configuration.

11. The fluid inflatable member of claim 10, wherein the compressed configuration is a rolled configuration, and the expanded configuration forms a semi-rigid structural member.

12. The fluid inflatable member of claim 11, wherein a rigidity of the semi-rigid structural member depends on a cellular structure of the porous material and an amount of incompressible fluid enclosed within the porous material.

13. The fluid inflatable member of claim 1, further comprising a compressible member coupled with the membrane such that, as the membrane is filled with the incompressible fluid, the compressible member expands to assume a predefined shape and, when the incompressible fluid is no longer directed into the membrane, the compressible member retracts to contract the inflatable member to an uninflated configuration.

14. The fluid inflatable member of claim 13, wherein the predefined shape is a cylinder.

15. A fluid inflatable member, comprising:

a pliable body having a membrane defining an interior space;

a porous material enclosed within the interior space of the pliable body wherein in response to the porous material being compressed, the porous material receives incompressible fluid from a fluid source and distributes the incompressible fluid throughout the interior space to increase a rigidity of the pliable body; and a compressible member coupled with the pliable body that exerts a force that acts to return the fluid inflatable member to an uninflated configuration by pushing the incompressible fluid out of the fluid inflatable member.

16. The fluid inflatable member of claim 1, further comprising a compressible member coupled with the pliable body, wherein the compressible member expands as the porous material receives the incompressible fluid from the fluid source and retracts when the incompressible fluid is no longer directed into the fluid inflatable member.

17. A fluid inflatable member, comprising:

a pliable body having a membrane defining an interior space;

a porous material enclosed within the interior space of the pliable body, wherein in response to porous material being compressed, the porous material receives fluid and distributes the fluid throughout the interior space to increase a rigidity of the pliable body; and a coiled spring coupled with the pliable body, wherein the coiled spring expands as the porous material receives the fluid.

18. The fluid inflatable member of claim 17, wherein the coiled spring extends a longitudinal length of the pliable body.

19. The fluid inflatable member of claim 16, wherein the compressible member is coupled with the membrane.

* * * * *